US011378991B1

(12) United States Patent
Goyal et al.

(10) Patent No.: US 11,378,991 B1
(45) Date of Patent: Jul. 5, 2022

(54) SOFT-START CIRCUIT FOR VOLTAGE REGULATOR

(71) Applicant: NXP B.V., Eindhoven (NL)

(72) Inventors: Saurabh Goyal, Sonipat (IN); Sanjay Kumar Wadhwa, Noida (IN); Divya Tripathi, Noida (IN)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 17/304,632

(22) Filed: Jun. 23, 2021

(51) Int. Cl.
*G05F 1/10* (2006.01)
*G05F 1/46* (2006.01)

(52) U.S. Cl.
CPC ..... *G05F 1/468* (2013.01)

(58) Field of Classification Search
CPC ..... G05F 1/468
See application file for complete search history.

(56) References Cited

U.S. PATENT DOCUMENTS 5,859,563 A * 1/1999 Yung ..... G05F 1/46 327/538
6,348,833 B1 * 2/2002 Tsujimoto ..... G05F 1/575 327/143
7,019,499 B2 * 3/2006 Chiu ..... G05F 1/56 323/279
7,459,891 B2 12/2008 Al-Shyoukh et al.
7,466,115 B2 * 12/2008 Biagi ..... H03F 1/02 323/273
7,573,252 B1 8/2009 Griesert
7,906,945 B2 3/2011 Kao et al.
8,044,708 B2 * 10/2011 Kume ..... G05F 1/56 327/538
8,076,914 B2 * 12/2011 Shimizu ..... H02M 3/1582 323/271
8,704,506 B2 4/2014 Lipka et al.
10,895,884 B2 1/2021 Kotrc et al.
2016/0116927 A1 * 4/2016 Chen ..... H02M 1/36 323/280
2021/0191438 A1 * 6/2021 Phogat ..... G05F 1/468

OTHER PUBLICATIONS

Mohammad Al-Shyoukh and Hoi Lee, "A Compact Ramp-Based Soft-Start Circuit for Voltage Regulators", IEEE Transactions on Circuits and Systems II: Express Briefs, Jul. 7, 2009, pp. 535-539, vol. 56, Issue. 7, IEEE.

* cited by examiner

*Primary Examiner* — Thomas J. Hiltunen

(57) ABSTRACT

A soft-start circuit for a voltage regulator includes a comparator and a delay circuit. The comparator compares an output voltage, that is generated by the voltage regulator, and a reference voltage to generate a comparison signal. Further, the delay circuit receives the reference voltage and a control signal that is outputted based on the comparison signal, and outputs and provides another reference voltage to the voltage regulator. During a start-up of the voltage regulator, the reference voltage outputted by the delay circuit is a delayed version of the reference voltage received by the delay circuit. Thus, the soft-start circuit mitigates an overshoot of the output voltage during the start-up. Further, on completion of the start-up, the reference voltage outputted by the delay circuit is equal to the reference voltage received by the delay circuit.

20 Claims, 3 Drawing Sheets

SOFT-START CIRCUIT FOR VOLTAGE REGULATOR

BACKGROUND

The present disclosure relates generally to electronic circuits, and, more particularly, to a soft-start circuit for a voltage regulator.

System-on-chips (SoCs) include various functional circuits (e.g., analog-to-digital converters, voltage-controlled oscillators, or the like) and various voltage regulators that provide output voltages to the functional circuits to drive the functional circuits. A voltage regulator generates an output voltage based on a reference voltage provided by a reference voltage generator. When an SoC is powered up, the reference voltage can increase at a significant rate resulting in an overshoot of the output voltage. The overshoot of the output voltage can damage an associated functional circuit.

Typically, to mitigate the overshoot of the output voltage, a soft-start circuit is utilized in the SoC. The soft-start circuit typically includes various current sources, switches, an unbalanced differential pair of transistors, and a differential amplifier. Utilization of such components in the soft-start circuit increases a size and a manufacturing cost of the soft-start circuit. The increased size and the increased manufacturing cost of the soft-start circuit lead to an increase in a size and a manufacturing cost of the SoC, respectively. Therefore, there exists a need for a technical solution that solves the aforementioned problems of existing soft-start circuits.

SUMMARY

In an embodiment of the present disclosure, a soft-start circuit for a voltage regulator is disclosed. The soft-start circuit can include a comparator and a delay circuit. The comparator can be coupled with the voltage regulator, and configured to compare an output voltage and a first reference voltage to generate a comparison signal. The output voltage can be generated by the voltage regulator. The delay circuit can be coupled with the voltage regulator, and configured to receive the first reference voltage and a first control signal, and output and provide a second reference voltage to the voltage regulator. The first control signal can be outputted based on the comparison signal. During a start-up of the voltage regulator, the second reference voltage can be a delayed version of the first reference voltage.

In another embodiment of the present disclosure, a system-on-chip (SoC) is disclosed. The SoC can include a voltage regulator that can be configured to generate an output voltage. The SoC can further include a soft-start circuit that can be coupled with the voltage regulator. The soft-start circuit can include a comparator and a delay circuit. The comparator can be coupled with the voltage regulator, and configured to compare the output voltage and a first reference voltage to generate a comparison signal. The delay circuit can be coupled with the voltage regulator, and configured to receive the first reference voltage and a first control signal, and output and provide a second reference voltage to the voltage regulator. The first control signal can be outputted based on the comparison signal. During a start-up of the voltage regulator, the second reference voltage can be a delayed version of the first reference voltage.

In some embodiments, the first control signal can be deactivated during the start-up of the voltage regulator. Further, the first control signal can be activated on completion of the start-up.

In some embodiments, the delay circuit can further include a resistor, a switch, and a capacitor. The resistor can be configured to receive the first reference voltage. The switch can be parallelly coupled with the resistor, and configured to receive the first control signal. The switch can be deactivated when the first control signal is deactivated, and activated when the first control signal is activated. Further, the capacitor can be coupled between the resistor and a ground terminal, and configured to output the second reference voltage. The capacitor can be further coupled with the voltage regulator, and configured to provide the second reference voltage to the voltage regulator.

In some embodiments, when the switch is deactivated, the second reference voltage can be the delayed version of the first reference voltage. Further, when the switch is activated, the second reference voltage can be equal to the first reference voltage.

In some embodiments, the comparison signal can be deactivated when the output voltage is less than the first reference voltage. Further, the comparison signal can be activated when the output voltage is greater than or equal to the first reference voltage.

In some embodiments, the soft-start circuit can further include a buffer and a logic gate. The buffer can be configured to receive a second control signal that is an inverted version of the first control signal. Further, the buffer can be configured to output a third control signal that is a delayed version of the second control signal. The logic gate is coupled with the comparator and the buffer, and configured to receive the comparison signal and the third control signal, respectively. Based on the comparison signal and the third control signal, the logic gate can be further configured to output a fourth control signal. The fourth control signal is activated when the comparison signal and the third control signal are activated, and the fourth control signal is deactivated when one of the comparison signal and the third control signal is deactivated.

In some embodiments, the soft-start circuit can further include a latch. The latch can have an input terminal, a control terminal, a clock terminal, and first and second output terminals. The input terminal of the latch can be configured to receive a supply voltage, and the control terminal of the latch can be configured to receive an enable signal. Further, the clock terminal of the latch can be coupled with the logic gate, and configured to receive the fourth control signal. The first and second output terminals of the latch can be configured to output the first and second control signals, respectively.

In some embodiments, when the enable signal is deactivated, the first control signal can be deactivated and the second control signal can be activated. Further, when the fourth control signal and the enable signal are activated, the first control signal can transition from a deactivated state to an activated state, and the second control signal can transition from an activated state to a deactivated state.

In some embodiments, the SoC can further include a system controller that can be coupled with the control terminal of the latch, and configured to generate and provide the enable signal to the control terminal of the latch to control an operation of the latch.

In some embodiments, the SoC can further include a reference voltage generator that can be coupled with the delay circuit and the comparator, and configured to generate and provide the first reference voltage to the delay circuit and the comparator.

In some embodiments, the SoC can further include a system controller that can be coupled with the reference voltage generator and the voltage regulator, and configured to generate and provide an enable signal to the reference voltage generator and the voltage regulator to control an operation of each of the reference voltage generator and the voltage regulator.

In some embodiments, the SoC can further include a functional circuit that can be coupled with the voltage regulator. The voltage regulator can be further configured to provide the output voltage to the functional circuit to drive the functional circuit.

Various embodiments of the present disclosure disclose a soft-start circuit for a voltage regulator. The soft-start circuit can include a comparator, a logic gate, a latch, a buffer, and a delay circuit. The comparator can receive an output voltage that is generated by the voltage regulator and a reference voltage that is generated by a reference voltage generator. The comparator can compare the output voltage and the reference voltage to generate a comparison signal. The logic gate can receive the comparison signal and a first control signal, and output a second control signal. The latch can receive the second control signal and a supply voltage, and output third and fourth control signals. The third control signal is deactivated during a start-up of the voltage regulator, and activated on completion of the start-up. Further, the fourth control signal is an inverted version of the third control signal. The buffer can receive the fourth control signal, and output the first control signal. The first control signal is a delayed version of the fourth control signal.

The delay circuit can include a resistor that can receive the reference voltage, and a switch that can be parallelly coupled with the resistor and receive the third control signal. The delay circuit can further include a capacitor that can be coupled between the resistor and a ground terminal, and output and provide another reference voltage to the voltage regulator. The voltage regulator can generate the output voltage based on the reference voltage outputted by the delay circuit. During the start-up of the voltage regulator, the switch is deactivated. Hence, the reference voltage outputted by the delay circuit can be a delayed version of the reference voltage generated by the reference voltage generator. Further, on the completion of the start-up, the switch is activated and the resistor is bypassed. Hence, the reference voltage outputted by the delay circuit can be equal to the reference voltage generated by the reference voltage generator.

Thus, the soft-start circuit delays the reference voltage received from the reference voltage generator during the start-up of the voltage regulator. As a result, the output voltage slowly ramps up until the output voltage is equal to the reference voltage generated by the reference voltage generator. An overshoot of the output voltage is thus mitigated. The soft-start circuit of the present disclosure mitigates the overshoot of the output voltage by way of one comparator, one resistor, one switch, one capacitor, one logic gate, one latch, and one buffer. As a result, a size and a manufacturing cost of the soft-start circuit of the present disclosure are significantly less than that of a conventional soft-start circuit that includes various components such as current sources, multiple switches, an unbalanced pair of transistors, and a differential amplifier. Thus, a size and a manufacturing cost of an SoC that includes the soft-start circuit of the present disclosure are significantly less than that of an SoC that includes the conventional soft-start circuit.

BRIEF DESCRIPTION OF THE DRAWINGS

The following detailed description of the preferred embodiments of the present disclosure will be better understood when read in conjunction with the appended drawings. The present disclosure is illustrated by way of example, and not limited by the accompanying figures, in which like references indicate similar elements.

DETAILED DESCRIPTION

The detailed description of the appended drawings is intended as a description of the currently preferred embodiments of the present disclosure, and is not intended to represent the only form in which the present disclosure may be practiced. It is to be understood that the same or equivalent functions may be accomplished by different embodiments that are intended to be encompassed within the spirit and scope of the present disclosure.

Figure 1:
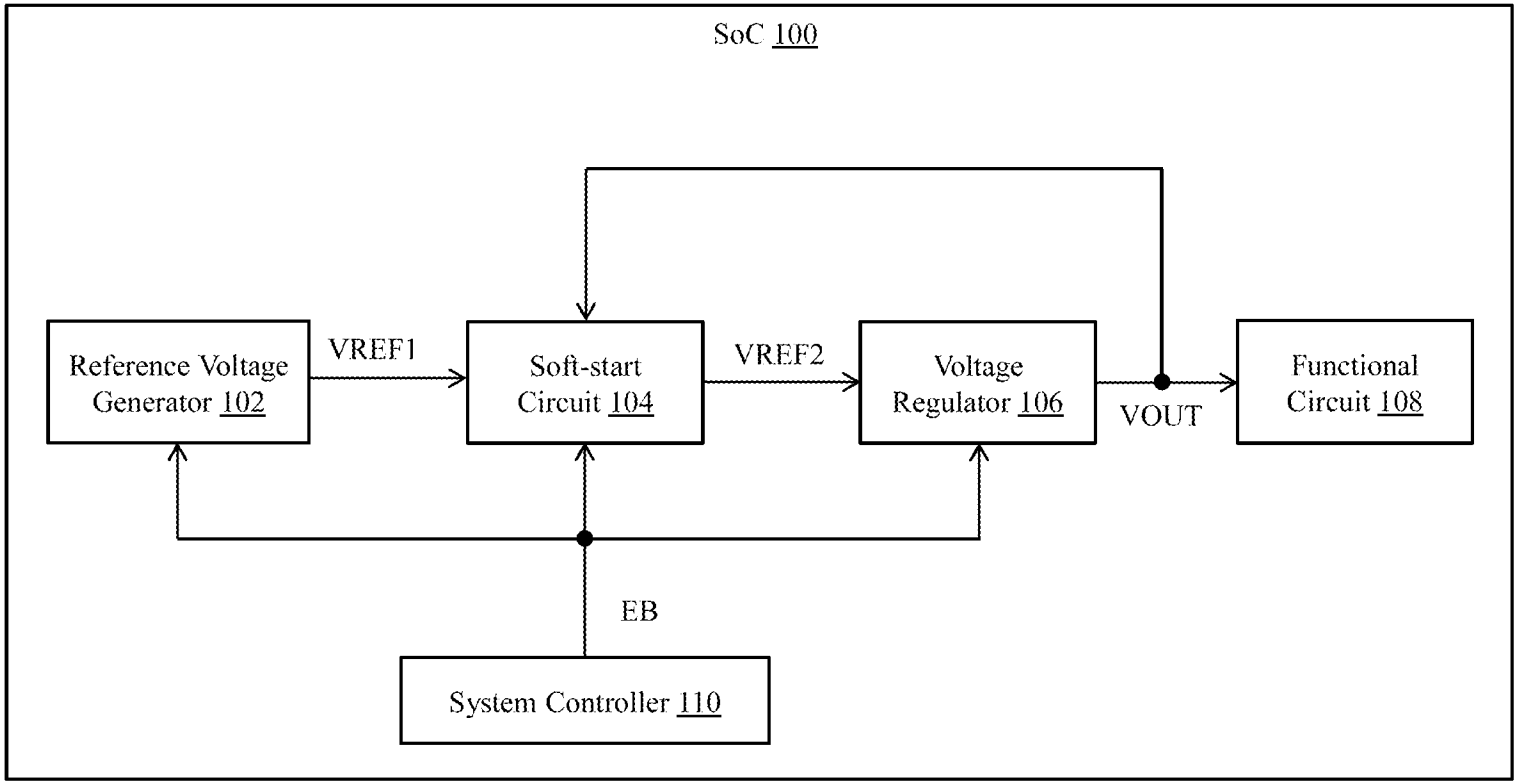
FIG. 1 illustrates a schematic block diagram of a system-on-chip (SoC) in accordance with an embodiment of the present disclosure.

FIG. 1 illustrates a schematic block diagram of a system-on-chip (SoC) 100 in accordance with an embodiment of the present disclosure. The SoC 100 can include a reference voltage generator 102, a soft-start circuit 104, a voltage regulator 106, a functional circuit 108, and a system controller 110. The SoC 100 can be utilized in various consumer electronic devices (e.g., mobile phones, digital cameras, and media players), various automotive devices, various data processing devices, various networking devices, or the like.

The reference voltage generator 102 can be coupled with the soft-start circuit 104 and the system controller 110. The reference voltage generator 102 can include suitable circuitry that can be configured to perform one or more operations. For example, the reference voltage generator 102 can be configured to receive an enable signal EB from the system controller 110. The enable signal EB controls an operation of the reference voltage generator 102. In an embodiment, when the enable signal EB is deactivated (e.g., is at a logic low state), the reference voltage generator 102 is deactivated (i.e., the reference voltage generator 102 is non-operational). Further, when the enable signal EB is activated (e.g., is at a logic high state), the reference voltage generator 102 is activated (i.e., the reference voltage generator 102 is operational). When the reference voltage generator 102 is operational, the reference voltage generator 102 can be configured to generate a first reference voltage VREF1. In an example, the first reference voltage VREF1 is equal to 0.5 volts. The reference voltage generator 102 can be further configured to provide the first reference voltage VREF1 to the soft-start circuit 104.

The soft-start circuit 104 can be coupled with the reference voltage generator 102, the system controller 110, and the voltage regulator 106. The soft-start circuit 104 can be configured to receive the first reference voltage VREF1, the enable signal EB, and the output voltage VOUT from the reference voltage generator 102, the system controller 110, and the voltage regulator 106, respectively. The enable signal EB controls an operation of the soft-start circuit 104. In an embodiment, when the enable signal EB is deactivated, the soft-start circuit 104 is deactivated (i.e., the soft-start circuit 104 is non-operational). Further, when the enable signal EB is activated, the soft-start circuit 104 is activated (i.e., the soft-start circuit 104 is operational).

When the soft-start circuit 104 is operational, the soft-start circuit 104 can be further configured to generate a second reference voltage VREF2 based on the first reference voltage VREF1 and the output voltage VOUT. During a start-up of the voltage regulator 106, the second reference voltage VREF2 can be a delayed version of the first reference voltage VREF1. In other words, during the start-up, a rate of increase of the second reference voltage VREF2 is less than that of the first reference voltage VREF1. Thus, the second reference voltage VREF2 slowly ramps up with respect to time. This mitigates the overshoot of the second reference voltage VREF2, and in turn, of the output voltage VOUT when the SoC 100 is powered up. Further, on completion of the start-up, the second reference voltage VREF2 can be equal to the first reference voltage VREF1. The soft-start circuit 104 can be further configured to provide the second reference voltage VREF2 to the voltage regulator 106. The soft-start circuit 104 is explained in detail in conjunction with FIGS. 2 and 3.

Although FIG. 1 illustrates that the soft-start circuit 104 is directly coupled with the reference voltage generator 102 and receives the first reference voltage VREF1 from the reference voltage generator 102, it will be apparent to a person skilled in the art that the scope of the present disclosure is not limited to it. In various other embodiments, a delay element (not shown) can be coupled between the reference voltage generator 102 and the soft-start circuit 104, without deviating from the scope of the present disclosure. In such a scenario, the delay element can be configured to receive the first reference voltage VREF1 from the reference voltage generator 102, and output and provide a third reference voltage (not shown) to the soft-start circuit 104. The soft-start circuit 104 can then output the second reference voltage VREF2 based on the third reference voltage in a similar manner as described above.

The voltage regulator 106 can be coupled with the soft-start circuit 104, the functional circuit 108, and the system controller 110. The voltage regulator 106 can include suitable circuitry that can be configured to perform one or more operations. For example, the voltage regulator 106 can be configured to receive the enable signal EB and the second reference voltage VREF2 from the system controller 110 and the soft-start circuit 104, respectively. The enable signal EB controls an operation of the voltage regulator 106. In an embodiment, when the enable signal EB is deactivated, the voltage regulator 106 is deactivated (i.e., the voltage regulator 106 is non-operational). Further, when the enable signal EB is activated, the voltage regulator 106 is activated (i.e., the voltage regulator 106 is operational).

When the voltage regulator 106 is operational, the voltage regulator 106 can be further configured to generate the output voltage VOUT. The output voltage VOUT can be generated by the voltage regulator 106 based on the second reference voltage VREF2. The voltage regulator 106 can be further configured to provide the output voltage VOUT to the soft-start circuit 104. In other words, the output voltage VOUT is fed back to the soft-start circuit 104. Further, the voltage regulator 106 can be configured to provide the output voltage VOUT to the functional circuit 108 to drive the functional circuit 108.

The functional circuit 108 can be coupled with the voltage regulator 106. The functional circuit 108 can be driven by the voltage regulator 106 by way of the output voltage VOUT. In such a scenario, the functional circuit 108 can be configured to execute various operations associated therewith. Examples of the functional circuit 108 can include analog-to-digital converters, voltage-controlled oscillators, or the like.

Although FIG. 1 illustrates that the SoC 100 includes a single functional circuit (i.e., the functional circuit 108), it will be apparent to a person skilled in the art that the scope of the present disclosure is not limited to it. In various other embodiments, the SoC 100 can include more than one functional circuit, without deviating from the scope of the present disclosure. In such a scenario, the voltage regulator 106 can be further configured to provide the output voltage VOUT to each functional circuit to drive the corresponding functional circuit.

The system controller 110 can be coupled with the reference voltage generator 102, the soft-start circuit 104, and the voltage regulator 106. The system controller 110 can include suitable circuitry that can be configured to perform one or more operations. For example, the system controller 110 can be configured to generate the enable signal EB. The system controller 110 can be further configured to provide the enable signal EB to the soft-start circuit 104 to control the operation of the soft-start circuit 104. Similarly, the system controller 110 can be further configured to provide the enable signal EB to the reference voltage generator 102 and the voltage regulator 106 to control the operation of each of the reference voltage generator 102 and the voltage regulator 106. In an embodiment, the system controller 110 activates the enable signal EB (e.g., generates the enable signal EB at a logic high state) after the SoC 100 is powered up to synchronously activate the reference voltage generator 102, the soft-start circuit 104, and the voltage regulator 106.

In operation, when the SoC 100 is powered, the enable signal EB is deactivated. As a result, the reference voltage generator 102, the soft-start circuit 104, and the voltage regulator 106 are deactivated. The system controller 110 can then activate the enable signal EB to synchronously activate the reference voltage generator 102, the soft-start circuit 104, and the voltage regulator 106. In such a scenario, the first reference voltage VREF1 increases at a significant rate. The soft-start circuit 104 can generate the second reference voltage VREF2 such that the second reference voltage VREF2 is the delayed version of the first reference voltage VREF1. The output voltage VOUT is thus less than the first reference voltage VREF1 during the start-up of the voltage regulator 106. The soft-start circuit 104 can thus mitigate the overshoot of the output voltage VOUT during the start-up of the voltage regulator 106. When the output voltage VOUT is equal to the first reference voltage VREF1, the soft-start circuit 104 outputs the second reference voltage VREF2 such that the second reference voltage VREF2 is equal to the first reference voltage VREF1. Thus, the voltage regulator 106 generates the output voltage VOUT based on the first reference voltage VREF1 on the completion of the start-up.

Figure 2:
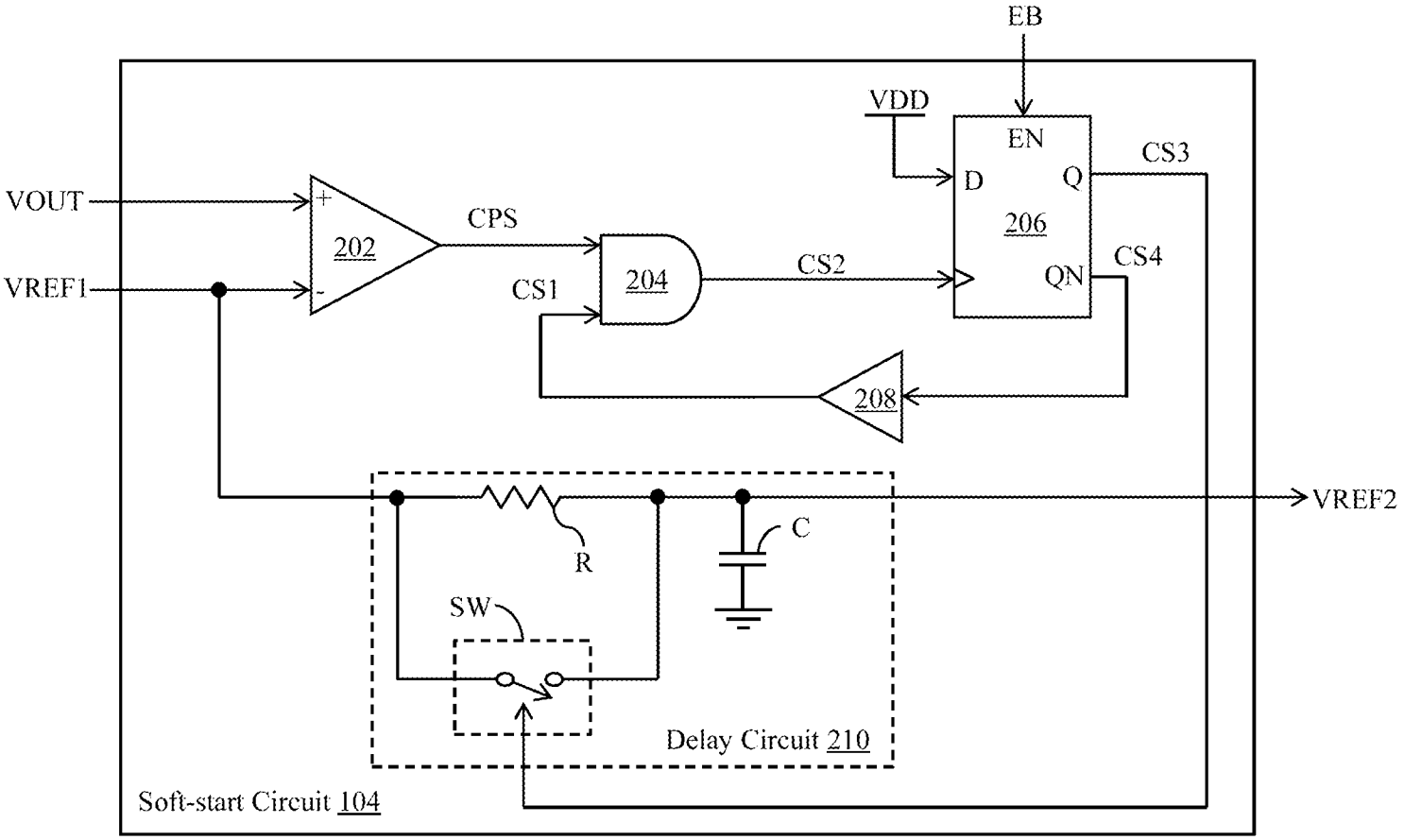
FIG. 2 illustrates a schematic circuit diagram of a soft-start circuit of the SoC of FIG. 1 in accordance with an embodiment of the present disclosure.

FIG. 2 illustrates a schematic circuit diagram of the soft-start circuit 104 in accordance with an embodiment of the present disclosure. The soft-start circuit 104 can include a comparator 202, a logic gate 204, a latch 206, a buffer 208, and a delay circuit 210.

The comparator 202 can be coupled with the reference voltage generator 102, the voltage regulator 106, and the logic gate 204. The comparator 202 can include suitable circuitry that can be configured to perform one or more operations. For example, the comparator 202 can be configured to receive the first reference voltage VREF1 from the reference voltage generator 102. In other words, the reference voltage generator 102 can be further configured to provide the first reference voltage VREF1 to the comparator 202. Further, the comparator 202 can be configured to receive the output voltage VOUT from the voltage regulator 106. In an embodiment, the comparator 202 receives the first reference voltage VREF1 and the output voltage VOUT at negative and positive input terminals thereof, respectively.

The comparator 202 can be further configured to compare the first reference voltage VREF1 and the output voltage VOUT to generate a comparison signal CPS. In an embodiment, when the output voltage VOUT is greater than or equal to the first reference voltage VREF1, the comparator 202 activates the comparison signal CPS (e.g., generates the comparison signal CPS at a logic high state). Further, the comparator 202 deactivates the comparison signal CPS (e.g., generates the comparison signal CPS at a logic low state) when the output voltage VOUT is less than the first reference voltage VREF1.

The logic gate 204 has first and second input terminals that can be coupled with the comparator 202 and the buffer 208, respectively. The first and second input terminals of the logic gate 204 can be configured to receive the comparison signal CPS and a first control signal CS1 from the comparator 202 and the buffer 208, respectively. The logic gate 204 further has an output terminal that can be coupled with the latch 206. The output terminal of the logic gate 204 can be configured to output and provide a second control signal CS2 to the latch 206. In an embodiment, the logic gate 204 is an AND gate. Thus, the logic gate 204 activates the second control signal CS2 (e.g., outputs the second control signal CS2 at a logic high state) when the comparison signal CPS is activated and the first control signal CS1 is activated (e.g., is at a logic high state). Further, the logic gate 204 deactivates the second control signal CS2 (e.g., output the second control signal CS2 at a logic low state) when one of the comparison signal CPS and the first control signal CS1 is deactivated (e.g., is at a logic low state).

The latch 206 has an input terminal, a clock terminal, and a control terminal that be can be coupled with a power supply (not shown), the output terminal of the logic gate 204, and the system controller 110, respectively. The input terminal of the latch 206 can be configured to receive a supply voltage VDD from the power supply. Further, the clock terminal of the latch 206 can be configured to receive the second control signal CS2 from the output terminal of the logic gate 204. In an embodiment, the clock terminal of the latch 206 corresponds to a positive clock terminal. Further, the control terminal of the latch 206 can be configured to receive the enable signal EB from the system controller 110. In other words, the system controller 110 can be configured to provide the enable signal EB to the control terminal of the latch 206 to control an operation of the latch 206.

The latch 206 further has first and second output terminals that can be configured to output a third control signal CS3 and a fourth control signal CS4, respectively. In an embodiment, the first and second output terminals of the latch 206 correspond to positive and negative output terminals, and output the third and fourth control signals CS3 and CS4 when the second control signal CS2 is activated, respectively. Thus, the fourth control signal CS4 can be an inverted version of the third control signal CS3. The third and fourth control signals CS3 and CS4 can be outputted based on the enable signal EB, the supply voltage VDD, and the second control signal CS2. Further, the second control signal CS2 can be outputted based on the comparison signal CPS. Thus, the third and fourth control signals CS3 and CS4 can be outputted based on the comparison signal CPS.

The first and second output terminals of the latch 206 can be coupled with the delay circuit 210 and the buffer 208. The first and second output terminals of the latch 206 can be further configured to provide the third and fourth control signals CS3 and CS4 to the delay circuit 210 and the buffer 208, respectively. In an embodiment, the latch 206 is a D-latch.

The buffer 208 has an input terminal and an output terminal that can be coupled with the second output terminal of the latch 206 and the second input terminal of the logic gate 204, respectively. The buffer 208 can be configured to receive the fourth control signal CS4 from the second output terminal of the latch 206, and output the first control signal CS1. The first control signal CS1 can be a delayed version of the fourth control signal CS4. The output terminal of the buffer 208 can be further configured to provide the first control signal CS1 to the second input terminal of the logic gate 204.

When the enable signal EB is deactivated, the latch 206 is deactivated (i.e., the latch 206 is non-operational). In such a scenario, the third control signal CS3 is deactivated (e.g., is at a logic low state) and the fourth control signal CS4 is activated. Further, when the enable signal EB is activated and the second control signal CS2 is deactivated, the logic states of the third and fourth control signals CS3 and CS4 are retained. Thus, the third control signal CS3 remains deactivated and the fourth control signal CS4 remains activated. Further, when the enable signal EB and the second control signal CS2 are activated, the third control signal CS3 transitions from a deactivated state to an activated state, and the fourth control signal CS4 transitions from an activated state to a deactivated state.

The deactivation of the fourth control signal CS4 results in the deactivation of the first control signal CS1. When the second control signal CS2 is then deactivated as a result of the deactivation of the first control signal CS1, the logic states of the third and fourth control signals CS3 and CS4 are retained. Hence, the third control signal CS3 remains activated and the fourth control signal CS4 remains deactivated. Thus, a combination of the logic gate 204, the latch 206, and the buffer 208 ensures that fluctuations in the comparison signal CPS do not result in erroneous toggling of the third and fourth control signals CS3 and CS4.

The delay circuit 210 can be coupled with the latch 206 (i.e., the first output terminal of the latch 206), the reference voltage generator 102, and the voltage regulator 106. The delay circuit 210 can be configured to receive the third control signal CS3 from the latch 206 (i.e., the first output terminal of the latch 206). Further, the delay circuit 210 can be configured to receive the first reference voltage VREF1 from the reference voltage generator 102. In other words, the reference voltage generator 102 can be further configured to provide the first reference voltage VREF1 to the delay circuit 210. Based on the first reference voltage VREF1 and the third control signal CS3, the delay circuit 210 can be further configured to output and provide the second reference voltage VREF2 to the voltage regulator 106.

During the start-up of the voltage regulator 106, the third control signal CS3 can be deactivated. In such a scenario, the second reference voltage VREF2 can be the delayed version of the first reference voltage VREF1. Further, the third control signal CS3 can be activated on the completion of the start-up. In such a scenario, the second reference voltage VREF2 can be equal to the first reference voltage VREF1. The delay circuit 210 can include a resistor R, a capacitor C, and a switch SW.

The resistor R has a first terminal that can be coupled with the reference voltage generator 102 and a second terminal that can be coupled with the capacitor C. The first terminal of the resistor R can be configured to receive the first reference voltage VREF1 from the reference voltage generator 102.

The switch SW has first and second data terminals that can be coupled with the first and second terminals of the resistor R, respectively. In other words, the switch SW can be parallelly coupled with the resistor R. The switch SW further has a control terminal that can be coupled with the latch 206 (i.e., the first output terminal of the latch 206). The control terminal of the switch SW can be configured to receive the third control signal CS3 from the latch 206 (i.e., the first output terminal of the latch 206). In an embodiment, the switch SW is deactivated (i.e., the switch SW is open) when the third control signal CS3 is deactivated. Further, the switch SW is activated (i.e., the switch SW is closed) when the third control signal CS3 is activated. Additionally, when the switch SW is activated, the resistor R is bypassed. Examples of the switch SW can include a transistor, a transmission gate, or the like.

The capacitor C has first and second terminals that can be coupled with the second terminal of the resistor R and a ground terminal, respectively. In other words, the capacitor C can be coupled between the resistor R (i.e., the second terminal of the resistor R) and the ground terminal. Further, the capacitor C can be configured to output the second reference voltage VREF2 based on a delay introduced by a combination of the resistor R and the capacitor C. When the switch SW is deactivated, the second reference voltage VREF2 can be the delayed version of the first reference voltage VREF1. Further, when the switch SW is activated, the resistor R is bypassed. Hence, the second reference voltage VREF2 can be equal to the first reference voltage VREF1. The activation of the switch SW on the completion of the start-up prevents a voltage drop across the resistor R based on leakage currents associated with the voltage regulator 106.

Figure 3:
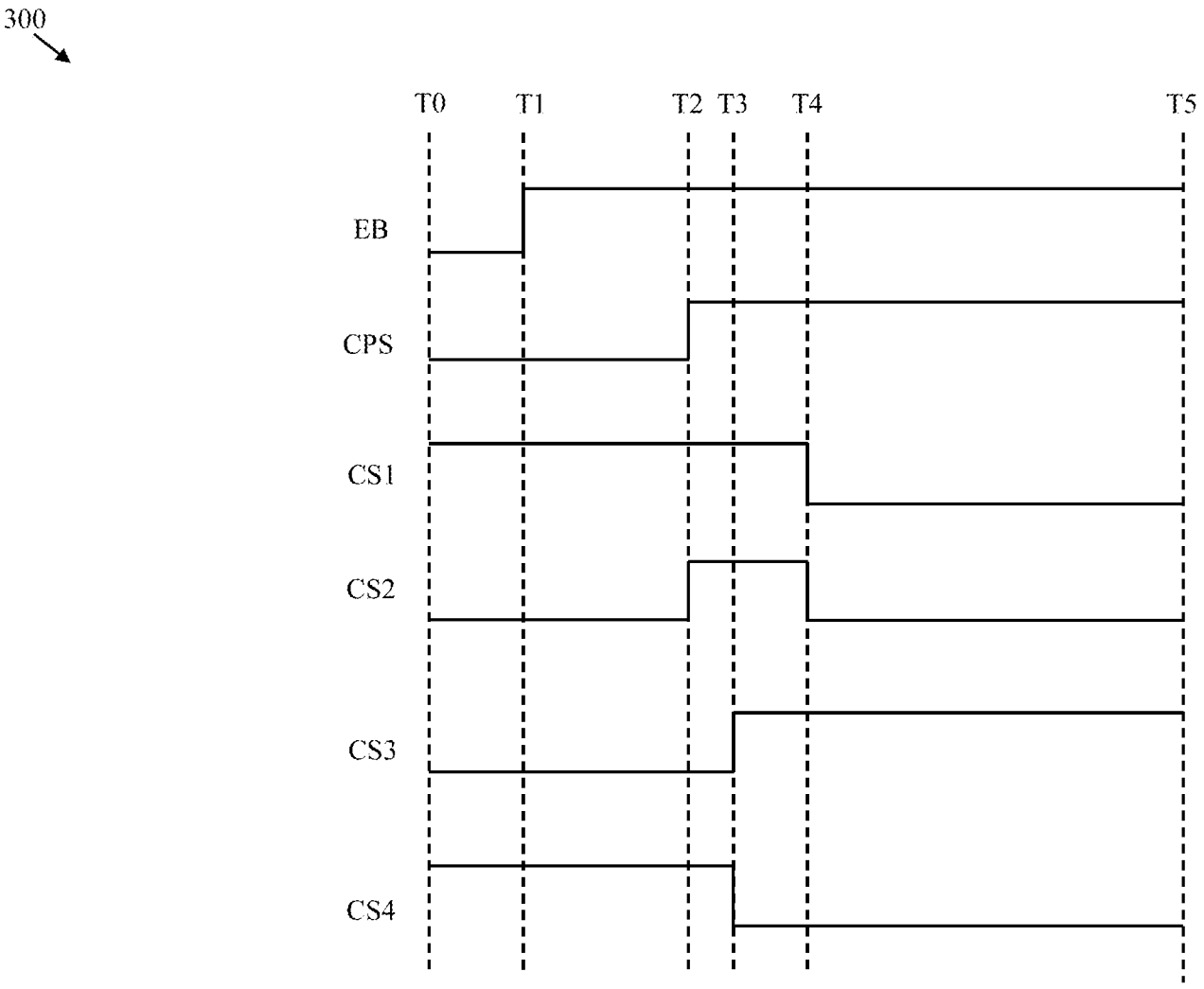
FIG. 3 represents a timing diagram that illustrates an operation of the soft-start circuit in accordance with an embodiment of the present disclosure.

FIG. 3 represents a timing diagram 300 that illustrates an operation of the soft-start circuit 104 in accordance with an embodiment of the present disclosure. The comparator 202 can receive the first reference voltage VREF1 and the output voltage VOUT from the reference voltage generator 102 and the voltage regulator 106, respectively. The delay circuit 210 can receive the first reference voltage VREF1 from the reference voltage generator 102, and the latch 206 can receive the supply voltage VDD and the enable signal EB from the power supply and the system controller 110, respectively.

During a time period T0-T1, the enable signal EB is at a logic low state. The time period T0-T1 can correspond to the powering up of the SoC 100. As the enable signal EB is at a logic low state, the latch 206 is deactivated. As a result, the third control signal CS3 is at a logic low state and the fourth control signal CS4 is at a logic high state. As the fourth control signal CS4 is at a logic high state, the first control signal CS1 is at a logic high state. Further, as the third control signal CS3 is at a logic low state, the switch SW is deactivated. The comparison signal CPS is at a logic low state as the enable signal EB is at a logic low state. As the second control signal CS2 is outputted based on the comparison signal CPS and the first control signal CS1, the second control signal CS2 is at a logic low state.

At a time instance T1, the enable signal EB transitions from a logic low state to a logic high state. The reference voltage generator 102, the soft-start circuit 104 (i.e., the latch 206), and the voltage regulator 106 are thus operational. At the time instance T1, the output voltage VOUT is less than the first reference voltage VREF1. As a result, the comparison signal CPS, and in turn, the second control signal CS2 remain at a logic low state. As the second control signal CS2 is at a logic low state, the third and fourth control signals CS3 and CS4 retain previous logic states. Thus, the third and fourth control signals CS3 and CS4 remain at a logic low state and a logic high state, respectively. Consequently, the first control signal CS1 remains at a logic high state. Further, as the third control signal CS3 remains at a logic low state, the switch SW remains deactivated. The delay circuit 210 can thus output the second reference voltage VREF2 that is the delayed version of the first reference voltage VREF1.

During a time period T1-T2, the output voltage VOUT increases based on the increase in the second reference voltage VREF2. However, the output voltage VOUT is less than the first reference voltage VREF1. Thus, the comparison signal CPS and the second and third control signals CS2 and CS3 remain at a logic low state. Similarly, the first and fourth control signals CS1 and CS4 remain at a logic high state. Further, the switch SW remains deactivated.

At a time instance T2, the output voltage VOUT is equal to the first reference voltage VREF1. Thus, the comparison signal CPS transitions from a logic low state to a logic high state. Further, the first control signal CS1 is the delayed version of the fourth control signal CS4. The first control signal CS1 is thus at a logic high state. As a result, the second control signal CS2 transitions from a logic low state to a logic high state. Further, due to a clock-to-q delay associated with the latch 206, the logic states of the third and fourth control signals CS3 and CS4 are retained (i.e., the third control signal CS3 remains at a logic low state and the fourth control signal CS4 remains at a logic high state). Further, as the third control signal CS3 remains at a logic low state, the switch SW remains deactivated.

During a time period T2-T3, the comparison signal CPS and the first, second, and fourth control signals CS1, CS2, and CS4 remain at a logic high state, and the third control signal CS3 remains at a logic low state. Further, the switch SW remains deactivated.

At a time instance T3, the activation of the second control signal CS2 at the time instance T2 results in the transition of the third control signal CS3 from a logic low state to a logic high state, and the transition of the fourth control signal CS4 from a logic high state to a logic low state. The time period T2-T3 can thus be equal to the clock-to-q delay associated with the latch 206. Further, the comparison signal CPS and the first control signal CS1 remain at a logic high state. As a result, the second control signal CS2 remains at a logic high state.

A time period T0-T3 can thus correspond to the start-up of the voltage regulator 106. The third control signal CS3 is at a logic low state during the start-up of the voltage regulator 106. Further, the transition of the third control signal CS3 from a logic low state to a logic high state is indicative of the completion of the start-up of the voltage regulator 106. As the third control signal CS3 is at a logic high state, the switch SW is activated. As a result, the resistor R is bypassed. Therefore, the second reference voltage VREF2 is equal to the first reference voltage VREF1.

During a time period T3-T4, the comparison signal CPS and the first through third control signals CS1-CS3 remain at a logic high state. Hence, the switch SW remains activated during the time period T3-T4, and the soft-start circuit 104 outputs the second reference voltage VREF2 that is equal to the first reference voltage VREF1. Further, the fourth control signal CS4 remains at a logic low state.

At a time instance T4, the deactivation of the fourth control signal CS4 at the time instance T3 results in the transition of the first control signal CS1 from a logic high state to a logic low state. As a result, the second control signal CS2 transitions from a logic high state to a logic low state. The time period T3-T4 can thus correspond to a delay value associated with the buffer 208. In such a scenario, the third and fourth control signals CS3 and CS4 retain previous logic states (i.e., the third control signal CS3 remains at a logic high state and the fourth control signal CS4 remains at a logic low state). As a result, the switch SW remains activated and the resistor R is bypassed. Therefore, the second reference voltage VREF2 is equal to the first reference voltage VREF1. Further, the comparison signal CPS remains at a logic high state.

During a time period T4-T5, the comparison signal CPS and the third control signal CS3 remain at a logic high state. Hence, the switch SW remains activated during the time period T4-T5, and the soft-start circuit 104 outputs the second reference voltage VREF2 that is equal to the first reference voltage VREF1. Further, the first, second and fourth control signals CS1, CS2, and CS4 remain at a logic low state. The enable signal EB remains at a logic high state for a time period T1-T5.

It will be apparent to a person skilled in the art that the transitions of various signals illustrated in FIGS. 3 (such as the enable signal EB, the comparison signal CPS, and the first through fourth control signals CS1-CS4) are sans set up time associated with each signal to make the illustrations concise and clear and should not be considered as a limitation of the present disclosure.

Thus, the soft-start circuit 104 of the present disclosure mitigates the overshoot of the output voltage VOUT by way of one comparator, one resistor, one switch, one capacitor, one logic gate, one latch, and one buffer. Utilization of such components in the soft-start circuit 104 of the present disclosure results in a size and a manufacturing cost of the soft-start circuit 104 being significantly less than that of a conventional soft-start circuit. The conventional soft-start circuit corresponds to a soft-start circuit that utilizes various components such as current sources, multiple switches, an unbalanced pair of transistors, and a differential amplifier to mitigate an overshoot of an output voltage. Thus, a size and a manufacturing cost of the SoC 100 that includes the soft-start circuit 104 of the present disclosure are significantly less than that of an SoC that includes the conventional soft-start circuit.

While various embodiments of the present disclosure have been illustrated and described, it will be clear that the present disclosure is not limited to these embodiments only. Numerous modifications, changes, variations, substitutions, and equivalents will be apparent to those skilled in the art, without departing from the spirit and scope of the present disclosure, as described in the claims. Further, unless stated otherwise, terms such as "first" and "second" are used to arbitrarily distinguish between the elements such terms describe. Thus, these terms are not necessarily intended to indicate temporal or other prioritization of such elements.

The invention claimed is:

1. A soft-start circuit for a voltage regulator, the soft-start circuit comprising:

a comparator that is coupled with the voltage regulator, and configured to compare an output voltage, that is generated by the voltage regulator, and a first reference voltage directly input to the comparator to generate a comparison signal; and a delay circuit that is coupled with the voltage regulator, and configured to receive a first control signal, that is outputted based on the comparison signal, and the first reference voltage, and output and provide a second reference voltage to the voltage regulator, wherein during a start-up of the voltage regulator, the second reference voltage is a delayed version of the first reference voltage and after completion of the startup, the second reference voltage is equal to the first reference voltage.

2. The soft-start circuit of claim 1, wherein the first control signal is deactivated during the start-up of the voltage regulator, and wherein the first control signal is activated on completion of the start-up.

3. The soft-start circuit of claim 1, wherein the delay circuit comprises:

a resistor that is configured to receive the first reference voltage;

a switch that is parallelly coupled with the resistor, and configured to receive the first control signal, wherein the switch is deactivated when the first control signal is deactivated, and the switch is activated when the first control signal is activated; and a capacitor that is coupled between the resistor and a ground terminal, and configured to output the second reference voltage, wherein the capacitor is further coupled with the voltage regulator, and configured to provide the second reference voltage to the voltage regulator.

4. The soft-start circuit of claim 3, wherein when the switch is deactivated, the second reference voltage is the delayed version of the first reference voltage, and when the switch is activated, the second reference voltage is equal to the first reference voltage.

5. The soft-start circuit of claim 1, wherein the comparison signal is deactivated when the output voltage is less than the first reference voltage, and the comparison signal is activated when the output voltage is greater than or equal to the first reference voltage.

6. The soft-start circuit of claim 1, further comprising:

a buffer configured to receive a second control signal that is an inverted version of the first control signal, and output a third control signal that is a delayed version of the second control signal; and a logic gate that is coupled with the comparator and the buffer, and configured to receive the comparison signal and the third control signal, respectively, and output a fourth control signal, wherein the fourth control signal is activated when the comparison signal and the third control signal are activated, and the fourth control signal is deactivated when one of the comparison signal and the third control signal is deactivated.

7. The soft-start circuit of claim 6, further comprising a latch that has (i) an input terminal configured to receive a supply voltage, (ii) a control terminal configured to receive an enable signal, (iii) a clock terminal coupled with the logic gate, and configured to receive the fourth control signal, and (iv) first and second output terminals configured to output the first and second control signals, respectively.

8. The soft-start circuit of claim 7, wherein when the enable signal is deactivated, the first control signal is deactivated and the second control signal is activated, and wherein when the fourth control signal and the enable signal are activated, the first control signal transitions from a deactivated state to an activated state, and the second control signal transitions from an activated state to a deactivated state.

9. A system-on-chip (SoC), comprising:

a voltage regulator that is configured to generate an output voltage; and a soft-start circuit that is coupled with the voltage regulator, wherein the soft-start circuit comprises:

a comparator that is coupled with the voltage regulator, and configured to compare the output voltage and a first reference voltage directly input to the comparator to generate a comparison signal; and a delay circuit that is coupled with the voltage regulator, and configured to receive a first control signal, that is outputted based on the comparison signal, and the first reference voltage, and output and provide a second reference voltage to the voltage regulator, wherein during a start-up of the voltage regulator, the second reference voltage is a delayed version of the first reference voltage and after completion of the startup, the second reference voltage is equal to the first reference voltage.

10. The SoC of claim 9, wherein the first control signal is deactivated during the start-up of the voltage regulator, and wherein the first control signal is activated on completion of the start-up.

11. The SoC of claim 9, wherein the delay circuit comprises:

a resistor that is configured to receive the first reference voltage;

a switch that is parallelly coupled with the resistor, and configured to receive the first control signal, wherein the switch is deactivated when the first control signal is deactivated, and the switch is activated when the first control signal is activated; and a capacitor that is coupled between the resistor and a ground terminal, and configured to output the second reference voltage, wherein the capacitor is further coupled with the voltage regulator, and configured to provide the second reference voltage to the voltage regulator.

12. The SoC of claim 11, wherein when the switch is deactivated, the second reference voltage is the delayed version of the first reference voltage, and when the switch is activated, the second reference voltage is equal to the first reference voltage.

13. The SoC of claim 9, wherein the comparison signal is deactivated when the output voltage is less than the first reference voltage, and the comparison signal is activated when the output voltage is greater than or equal to the first reference voltage.

14. The SoC of claim 9, wherein the soft-start circuit further comprises:

a buffer configured to receive a second control signal that is an inverted version of the first control signal, and output a third control signal that is a delayed version of the second control signal; and a logic gate that is coupled with the comparator and the buffer, and configured to receive the comparison signal and the third control signal, respectively, and output a fourth control signal, wherein the fourth control signal is activated when the comparison signal and the third control signal are activated, and the fourth control signal is deactivated when one of the comparison signal and the third control signal is deactivated.

15. The SoC of claim 14, wherein the soft-start circuit further comprises a latch that has (i) an input terminal configured to receive a supply voltage, (ii) a control terminal configured to receive an enable signal, (iii) a clock terminal coupled with the logic gate, and configured to receive the fourth control signal, and (iv) first and second output terminals configured to output the first and second control signals, respectively.

16. The SoC of claim 15, wherein when the enable signal is deactivated, the first control signal is deactivated and the second control signal is activated, and wherein when the fourth control signal and the enable signal are activated, the first control signal transitions from a deactivated state to an activated state, and the second control signal transitions from an activated state to a deactivated state.

17. The SoC of claim 15, further comprising a system controller that is coupled with the control terminal of the latch, and configured to generate and provide the enable signal to the control terminal of the latch to control an operation of the latch.

18. The SoC of claim 9, further comprising a reference voltage generator that is coupled with the delay circuit and the comparator, and configured to generate and provide the first reference voltage to the delay circuit and the comparator.

19. The SoC of claim 18, further comprising a system controller coupled with the reference voltage generator and the voltage regulator, and configured to generate and provide an enable signal to the reference voltage generator and the voltage regulator to control an operation of each of the reference voltage generator and the voltage regulator.

20. The SoC of claim 9, further comprising a functional circuit that is coupled with the voltage regulator, wherein the voltage regulator is further configured to provide the output voltage to the functional circuit to drive the functional circuit.

* * * * *